US012729420B2

(12) United States Patent
Matsuda et al.

(10) Patent No.: US 12,729,420 B2
(45) **Date of Patent: *Sep. 8, 2026**

(54) STEEL SHEET AND PLATED STEEL SHEET

(71) Applicant: NIPPON STEEL CORPORATION, Tokyo (JP)

(72) Inventors: Keitaro Matsuda, Tokyo (JP); Takuya Mitsunobu, Tokyo (JP); Jun Maki, Tokyo (JP); Hiroshi Takebayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 385 days.

This patent is subject to a terminal disclaimer.

(21) Appl. No.: 18/288,223

(22) PCT Filed: Apr. 27, 2021

(86) PCT No.: PCT/JP2021/016832

§ 371 (c)(1),
(2) Date: Oct. 25, 2023

(87) PCT Pub. No.: WO2022/230064

PCT Pub. Date: Nov. 3, 2022

(65) Prior Publication Data

US 2024/0218491 A1 Jul. 4, 2024

(51) Int. Cl.
*C22C 38/38* (2006.01)
*C21D 1/74* (2006.01)
(Continued)

(52) U.S. Cl.
CPC ..... *C22C 38/38* (2013.01); *C21D 1/74* (2013.01); *C21D 6/001* (2013.01); *C21D 6/002* (2013.01);
(Continued)

(58) Field of Classification Search
None
See application file for complete search history.

(56) References Cited

U.S. PATENT DOCUMENTS

2015/0329946 A1* 11/2015 Yasui ..... C23C 28/345 148/533
2016/0160335 A1 6/2016 Ikeda
(Continued)

FOREIGN PATENT DOCUMENTS

JP 4-202632 A 7/1992
JP 2013-60630 A 4/2013
(Continued)

*Primary Examiner* — Seth Dumbris
(74) *Attorney, Agent, or Firm* — Birch, Stewart, Kolasch & Birch, LLP

(57) ABSTRACT

A steel sheet comprising, by mass %, C: 0.05 to 0.40%, Si: 0.2 to 3.0%, and Mn: 0.1 to 5.0%, wherein a surface layer of the steel sheet contains grain boundary oxides, a Ratio A of a length of the grain boundary oxides projected on a surface of the steel sheet to a length of the surface of the steel sheet is 50% or more and 100% or less, a number density of granular oxides is less than 4.0/μm$^2$, the steel sheet comprises an Si—Mn depleted layer having a thickness of 3.0 μm or more from the surface of the steel sheet, and Si and Mn contents of the Si—Mn depleted layer at the ½ position of the thickness and not containing oxides are respectively less than 10% of the Si and Mn contents at a sheet thickness center part of the steel sheet, and a plated steel sheet using the same are provided.

10 Claims, 1 Drawing Sheet

(51) Int. Cl.

| | |
|---|---|
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/34*** | (2006.01) |
| ***C23C 2/06*** | (2006.01) |

(52) U.S. Cl.

CPC ..... *C21D 6/005* (2013.01); *C21D 6/008* (2013.01); *C21D 8/02* (2013.01); *C21D 8/0226* (2013.01); *C21D 8/0236* (2013.01); *C21D 8/0252* (2013.01); *C21D 8/0263* (2013.01); *C21D 8/0278* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/34* (2013.01); *C23C 2/06* (2013.01)

(56) References Cited

U.S. PATENT DOCUMENTS

| | | | | |
|---|---|---|---|---|
| 2017/0369974 | A1* | 12/2017 | Kim | C21D 8/0226 |
| 2018/0002799 | A1 | 1/2018 | Futamura et al. | |
| 2020/0001342 | A1* | 1/2020 | Toda | C23C 2/06 |
| 2023/0002845 | A1* | 1/2023 | Kang | C22C 38/38 |

FOREIGN PATENT DOCUMENTS

| | | | |
|---|---|---|---|
| JP | 2016-130357 | A | 7/2016 |
| JP | 2018-193614 | A | 12/2018 |
| KR | 10-2015-0088310 | A | 7/2015 |

* cited by examiner

STEEL SHEET AND PLATED STEEL SHEET

FIELD

The present invention relates to a steel sheet and plated steel sheet. More specifically, the present invention relates to a high strength steel sheet and plated steel sheet having high plateability and hydrogen dischargeability.

BACKGROUND

In recent years, steel sheets used in automobiles, household electrical appliances, building materials, and other various fields have been made increasingly higher in strength. For example, the use of a high strength steel sheet has increased in the field of automobiles for the purpose of reducing vehicle body weight to improve fuel economy. Such a high strength steel sheet typically includes elements such as C, Si, and Mn to improve the strength of the steel.

In the production of a high strength steel sheet, heat treatment such as annealing is generally performed after rolling. Furthermore, among the elements typically included in the high strength steel sheet, the easily oxidizable elements of Si and Mn may bond with the oxygen in the atmosphere during the heat treatment and sometimes form an oxide-including layer in the vicinity of the surface of the steel sheet. The forms that such a layer takes include a form in which oxides including Si or Mn form a film on the outside (surface) of the steel sheet (external oxidation layer) and a form in which the oxides are formed on the inside (surface layer) of the steel sheet (internal oxidation layer).

When forming a plating layer (for example, a Zn-based plating layer) on the surface of a steel sheet having an external oxidation layer, oxides will be present as a film on the surface of the steel sheet and will therefore impede interdiffusion between the steel constituents (for example, Fe) and plating constituents (for example, Zn) thereby affecting the adhesion between the steel and the plating, sometimes resulting in insufficient plateability (for example, there will be an increase in non-plated parts). Therefore, from the viewpoint of improving plateability, a steel sheet formed with an internal oxidation layer is more preferable than a steel sheet formed with an external oxidation layer.

In relation to internal oxidation layers, PTLs 1 and 2 describe a high strength plated steel sheet with a tensile strength of 980 MPa or more comprised of a plated steel sheet having a zinc-based plating layer on a base steel sheet including C, Si, Mn, etc., and having an internal oxidation layer including an oxide of Si and/or Mn on a surface layer of the base steel sheet.

Further, PTL 3 proposes a method of production of high strength hot dip galvanized steel sheet of high Si content steel suitably controlling the annealing conditions, since, in the case of high Si content steel having a concentration of Si in the steel of 0.3% or more, the Si etc. in the steel diffuses to the surface layer of the steel sheet as oxides due to heating of the surface of the steel sheet and these oxides obstruct the wettability of the plating and worsen the plating adhesion.

CITATIONS LIST

Patent Literature

[PTL 1] Japanese Unexamined Patent Publication No. 2016-130357

[PTL 2] Japanese Unexamined Patent Publication No. 2018-193614

[PTL 3] Japanese Unexamined Patent Publication No. 4-202632

SUMMARY

Technical Problem

If annealing steel sheet in the process of production of a high strength steel sheet, sometimes the hydrogen present in the atmosphere at the time of annealing will penetrate the inside of the steel sheet. Hydrogen penetrating the inside of the steel sheet segregates at the martensite grain boundaries of the steel microstructure and causes the grain boundaries to become brittle to thereby possibly cause cracks in the steel sheet. This phenomenon of cracking occurring due to penetrated hydrogen is called "hydrogen embrittlement cracking (delayed fracture)" and often becomes a problem at the time of working the steel sheet. Therefore, to prevent hydrogen embrittlement cracking, it is effective to efficiently discharge the hydrogen penetrating the steel sheet at the time of annealing from the inside of the steel sheet to the outside of the system.

PTLs 1 and 2 teach that by controlling the average depth of the internal oxidation layer to a thick 4 μm or more and having the internal oxidation layer function as hydrogen trap sites by the method of oxidation in the oxidation zone by a 0.9 to 1.4 air ratio or air-fuel ratio and then reduction of the oxide film in a hydrogen atmosphere in the reduction zone, it is possible to prevent penetration of hydrogen and suppress hydrogen embrittlement. PTL 3 similarly specifically discloses heating in the oxidation zone by a 0.95 to 1.10 air ratio. However, in each of these documents, controlling the form of the oxides present in the internal oxidation layer has not been studied at all. There is still room for improvement of hydrogen dischargeability (hydrogen embrittlement resistance).

In consideration of these circumstances, the object of the present invention is to provide a high strength steel sheet and plated steel sheet having high plateability and hydrogen dischargeability.

Solution to Problem

The inventors discovered that to solve the above problem it is important to form oxides in the surface layer of the steel sheet, i.e., on the inside of the steel sheet, and furthermore, to control the form of the oxides present in the surface layer of the steel sheet and also to control the Si—Mn depleted layer formed at the surface layer of the steel sheet due to formation of such oxides to within predetermined ranges of thickness and composition. In further detail, the inventors discovered that high hydrogen dischargeability could be achieved by forming internal oxides to secure high plateability and forming, as the form of oxides, grain boundary oxides present so as to run along the crystal grain boundaries of the metallographic structure by a large amount, making the grain boundary oxides function as escape routes of hydrogen penetrating the inside of the steel at the time of annealing, and promoting the discharge of hydrogen from inside of the steel to outside of the same and further by forming an Si—Mn depleted layer having a predetermined thickness and composition on the surface layer of the steel sheet to thereby promote hydrogen diffusion in the steel. Further, the inventors discovered that in obtaining high hydrogen dischargeability, it is effective to suppress the formation of granular oxides present inside the crystal grains.

The present invention is based on the above findings and has as its gist the following:

(1) A steel sheet having a chemical composition comprising, by mass %,
C: 0.05 to 0.40%,
Si: 0.2 to 3.0%,
Mn: 0.1 to 5.0%,
sol. Al: 0 to less than 0.4000%,
P: 0.0300% or less,
S: 0.0300% or less,
N: 0.0100% or less,
B: 0 to 0.010%,
Ti: 0 to 0.150%,
Nb: 0 to 0.150%,
V: 0 to 0.150%,
Cr: 0 to 2.00%,
Ni: 0 to 2.00%,
Cu: 0 to 2.00%,
Mo: 0 to 1.00%,
W: 0 to 1.00%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein
a surface layer of the steel sheet contains grain boundary oxides,
a Ratio A of a length of the grain boundary oxides projected on a surface of the steel sheet to a length of the surface of the steel sheet when examining a cross-section of the surface layer of the steel sheet is 50% or more and 100% or less,
a number density of granular oxides is less than 4.0/$\mu m^2$,
the steel sheet comprises an Si—Mn depleted layer having a thickness of 3.0 μm or more from the surface of the steel sheet, and
Si and Mn contents of the Si—Mn depleted layer at ½ position of the thickness and not containing oxides are respectively less than 10% of the Si and Mn contents at a sheet thickness center part of the steel sheet.

(2) The steel sheet according to (1), wherein the Ratio A is 80% or more.

(3) The steel sheet according to (1), wherein the Ratio A is 90% or more.

(4) The steel sheet according to any one of (1) to (3), wherein the number density of the granular oxides is less than 2.0/$\mu m^2$.

(5) A plated steel sheet having a plating layer including Zn on the steel sheet of any one of (1) to (4).

Advantageous Effects of Invention

According to the present invention, by making the grain boundary oxides present in the surface layer of the steel sheet so as to run along the crystal grain boundaries of the metallographic structure function as escape routes for hydrogen penetrating inside the steel and promoting discharge of hydrogen from inside the steel to outside the system and further by including an Si—Mn depleted layer having a predetermined thickness and composition so as promote diffusion of hydrogen, it is possible to greatly improve the hydrogen dischargeability. As a result, it becomes possible to greatly reduce the amount of hydrogen built up inside the steel. Further, according to the present invention, since granular oxides are formed inside of the steel sheet, if forming a plating layer, the steel constituents and plating constituents sufficiently interdiffuse and high plateability can be obtained. Accordingly, according to the present invention, it becomes possible to obtain a high plateability and hydrogen dischargeability in a high strength steel sheet.

DESCRIPTION OF EMBODIMENTS

<Steel Sheet>

The steel sheet according to the present invention has a chemical composition comprising, by mass %,
C: 0.05 to 0.40%,
Si: 0.2 to 3.0%,
Mn: 0.1 to 5.0%,
sol. Al: 0 to less than 0.4000%,
P: 0.0300% or less,
S: 0.0300% or less,
N: 0.0100% or less,
B: 0 to 0.010%,
Ti: 0 to 0.150%,
Nb: 0 to 0.150%,
V: 0 to 0.150%,
Cr: 0 to 2.00%,
Ni: 0 to 2.00%,
Cu: 0 to 2.00%,
Mo: 0 to 1.00%,
W: 0 to 1.00%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein
a surface layer of the steel sheet contains grain boundary oxides,
a Ratio A of a length of the grain boundary oxides projected on a surface of the steel sheet to a length of the surface of the steel sheet when examining a cross-section of the surface layer of the steel sheet is 50% or more and 100% or less,
a number density of granular oxides is less than 4.0/$\mu m^2$,
the steel sheet comprises an Si—Mn depleted layer having a thickness of 3.0 μm or more from the surface of the steel sheet, and
Si and Mn contents of the Si—Mn depleted layer at ½ position of the thickness and not containing oxides are respectively less than 10% of the Si and Mn contents at a sheet thickness center part of the steel sheet.

In the production of a high strength steel sheet, a steel slab adjusted to a predetermined chemical composition is rolled (typically, hot rolled and cold rolled), then generally annealed for the purpose of obtaining the desired microstructure, etc. In the annealing, the comparatively easily oxidizable constituents in the steel sheet (for example, Si and Mn) bond with the oxygen in the annealing atmosphere whereby a layer including oxides is formed in the vicinity of the surface of the steel sheet. For example, like the steel sheet 1 shown in FIG. 1, an external oxidation layer 2 is formed as a film on the surface of the base steel 3 (i.e., the outside of the base steel 3). If an external oxidation layer 2 is formed as a film on the surface of the base steel 3, in the case of forming a plating layer (for example, zinc-based plating layer), the external oxidation layer 2 will impede interdiffusion between the plating constituents (for example, Zn) and steel constituents (for example, Fe), and therefore sometimes sufficient adhesion between the steel and plating cannot be secured and non-plated parts where no plating layer is formed will arise.

Figure 1:
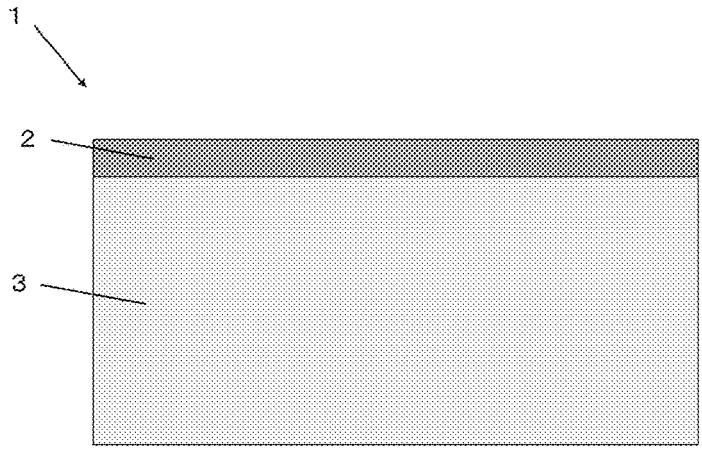
FIG. 1 is a schematic view of a cross-section of a steel sheet having an external oxidation layer.
Figure 2:
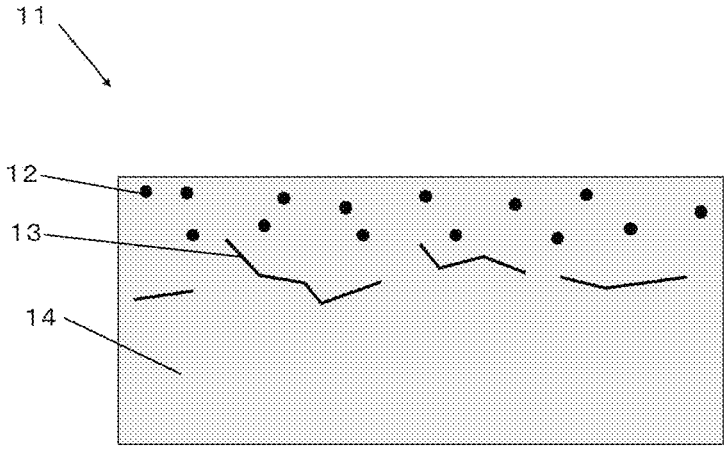
FIG. 2 is a schematic view regarding a cross-section of the illustrated steel sheet according to the present invention.

In contrast, as illustrated in FIG. 2, the steel sheet 11 according to the present invention does not have an external oxidation layer 2 formed on the surface of the base steel 3 like the steel sheet 1 shown in FIG. 1, but has oxides 12, 13 (preferably only oxides 13) present at the inside of the base steel 14. Accordingly, when forming a plating layer on the surface of the steel sheet 11, the steel sheet 11 according to the present invention in which oxides are formed inside of the base steel can achieve sufficient interdiffusion between the plating constituents and steel constituents and can obtain high plateability in comparison to steel sheet 1 having an external oxidation layer 2. Therefore, the inventors discovered that from the viewpoint of achieving high plateability, it is effective to control the conditions during annealing to form oxides at the inside of the steel sheet. The term "high plateability", when used regarding a steel sheet, means that when plating the steel sheet, it is possible to form a plating layer in a state in which there are few non-plated parts (parts where the plating layer is not formed) (for example, 5.0 area % or less) or none at all. Further, the term "high plateability", when used regarding a plated steel sheet, means a plated steel sheet in a state with extremely few non-plated parts (for example, 5.0 area % or less) or none at all.

On the other hand, it is known that, in annealing, hydrogen present in the annealing atmosphere penetrates the base steel whereby the penetrated hydrogen segregates at the martensite grain boundaries of the base steel and causes the grain boundaries to become brittle and hydrogen embrittlement cracking to occur. For this reason, to prevent hydrogen embrittlement cracking of the steel sheet, it is preferable to discharge the hydrogen penetrating the steel efficiently to outside of the system, i.e., have a high hydrogen dischargeability. The inventors discovered that by controlling the form of the oxides present at the surface layer of the steel sheet and by controlling the Si—Mn depleted layer formed at the surface layer of the steel sheet due to the formation of such oxides to within predetermined ranges of thickness and composition, more specifically by making a large part or all of the oxides grain boundary oxides connecting the inside of the steel sheet and the surface of the steel sheet, the oxides exhibit the function of discharging the hydrogen penetrating the steel during annealing and further that by forming the Si—Mn depleted layer having the predetermined thickness and composition at the surface layer of the steel sheet, diffusion of hydrogen in the steel is promoted and as a result the hydrogen in the steel can be efficiently discharged to outside of the system. More specifically, the inventors analyzed in detail the relationship between the form of oxides and the effectiveness as escape routes for hydrogen and as a result discovered that it is effective to raise the ratio of presence of grain boundary oxides of the base steel 14 (Ratio A), more specifically raise the Ratio A to 50% or more. While not being bound to any specific theory, the function of the oxides in the steel sheet of discharging penetrated hydrogen is believed to have a positive correlation with the Ratio A of the oxides. That is, it is believed that by the grain boundary oxides being present by a high Ratio A, the escape routes allowing the hydrogen penetrating inside the steel sheet to be discharged increase and the hydrogen discharge function is improved. Therefore, the inventors discovered that it is important, from the viewpoint of achieving high hydrogen dischargeability, to control conditions at the time of production of a steel sheet, particularly at the time of annealing, so that grain boundary oxides functioning as escape routes for hydrogen penetrating the steel at the time of annealing are present in a high ratio and preferably down to a further deeper position.

Further, the inventors analyzed in detail the relationship between the form of the Si—Mn depleted layer formed due to the drop in the concentrations of Si and Mn in the surroundings caused by the formation of oxides 12, 13 and other internal oxides such as shown in FIG. 2 and the dischargeability of hydrogen and as a result discovered that it was effective to control the Si—Mn depleted layer to predetermined ranges of thickness and composition, more specifically make the thickness of the Si—Mn depleted layer 3.0 μm or more from the surface of the steel sheet and control the Si and Mn contents of the Si—Mn depleted layer not containing oxides at the ½ position of the thickness to become respectively less than 10% of the Si and Mn contents at the sheet thickness center part of the steel sheet (below, these values will also be referred to as the "Si depletion rate" and the "Mn depletion rate"). While not being bound by any specific theory, in the case of steel containing a large amount of Si and/or Mn, the Si and/or Mn dissolved in the steel similarly become greater as well, and therefore it is believed these dissolved Si and/or Mn obstruct diffusion of hydrogen and as a result the speed of diffusion of hydrogen in the steel becomes slower. As shown in FIG. 2, if oxides 12, 13 and other internal oxides are formed at the surface layer of the steel sheet, the Si and Mn which had dissolved in the steel are consumed in the form of internal oxides, and therefore at the surface layer of the steel sheet, internal oxides are formed and an Si—Mn depleted layer in which the concentrations of Si and Mn relatively fall is formed in the surroundings. Therefore, by making the Si—Mn depleted layer relatively thick, specifically by controlling the thickness of the Si—Mn depleted layer to 3.0 μm or more from the surface of the steel sheet (if there is a plating layer present on the surface of the steel sheet, the interface of the plating layer and steel sheet), it is believed possible to sufficiently secure diffusion routes for the hydrogen while by further making the Si and Mn contents of the Si—Mn depleted layer sufficiently low, specifically by controlling the Si and Mn depletion rates to respectively less than 10%, it is believed possible to sufficiently reduce the amount of dissolved Si and Mn impeding diffusion of hydrogen. Therefore, by including an Si—Mn depleted layer controlled in thickness and composition to the above ranges, it is believed to become possible to promote the diffusion of hydrogen and improve the dischargeability of hydrogen from inside the steel. Accordingly, by combining the above-mentioned grain boundary oxides and the Si—Mn depleted layer, it becomes possible to remarkably improve the hydrogen dischargeability.

Further, the inventors discovered that to obtain the hydrogen discharge function of the grain boundary oxides to the maximum extent, it is important to keep down the formation of granular oxides, separate forms of oxides from grain boundary oxides, at the surface layer. The granular oxides are selectively formed at the surface layer and impede the formation of grain boundary oxides at the surface layer. Further, if grain boundary oxides are excessively present, they function as trap sites for hydrogen trying to escape to outside the system and sometimes cause a drop in the hydrogen discharge function. Therefore, from the viewpoint of further improving the hydrogen discharge function, the inventors discovered that in addition to the combination of the grain boundary oxides and Si—Mn depleted layer explained above, it is important to suppress the formation of granular oxides, more specifically control the number density of granular oxides (number per unit area).

Below, the steel sheet according to the present invention will be explained in detail. The thickness of the steel sheet according to the present invention is not particularly limited but may be, for example, 0.1 to 3.2 mm.

[Chemical Composition of Steel Sheet]

The chemical composition contained in the steel sheet according to the present invention will be explained next. The "%" regarding content of the elements, unless otherwise stated, will mean "mass %". In the numerical ranges in the chemical composition, a numerical range expressed using "to", unless otherwise indicated, will mean a range having the numerical values before and after the "to" as the lower limit value and the upper limit value.

(C: 0.05 to 0.40%)

C (carbon) is an important element for securing the strength of steel. To secure sufficient strength and furthermore obtain the desired form of the internal oxides, the C content is 0.05% or more. The C content is preferably 0.07% or more, more preferably 0.10% or more, even more preferably 0.12% or more. On the other hand, if the C content is excessive, the weldability is liable to fall. Accordingly, the C content is 0.40% or less. The C content may also be 0.38% or less, 0.35% or less, 0.32% or less, or 0.30% or less.

(Si: 0.2 to 3.0%)

Si (silicon) is an element effective for improving the strength of steel. To secure sufficient strength and furthermore sufficiently cause the formation of the desired oxides, in particular, grain boundary oxides inside the steel sheet, the Si content is 0.2% or more. The Si content is preferably 0.3% or more, more preferably 0.5% or more, further preferably 1.0% or more. On the other hand, if the Si content is excessive, deterioration of the surface properties is liable to be triggered and growth of external oxides is liable to be promoted. Accordingly, the Si content is 3.0% or less. The Si content may also be 2.8% or less, 2.5% or less, 2.3% or less, or 2.0% or less.

(Mn: 0.1 to 5.0%)

Mn (manganese) is an element effective for obtaining hard structures to improve the strength of steel. To secure sufficient strength and further make the desired oxides, in particular grain boundary oxides, sufficiently form inside of the steel sheet, the Mn content is 0.10% or more. The Mn content is preferably 0.5% or more, more preferably 1.0% or more, further preferably 1.5% or more. On the other hand, if the Mn content is excessive, the metallographic structure is liable to become uneven due to Mn segregation and the workability to decline, and growth of external oxides is liable to be promoted. Accordingly, the Mn content is 5.0% or less. The Mn content may also be 4.5% or less, 4.0% or less, 3.5% or less, or 3.0% or less.

(Sol. Al: 0 to Less than 0.4000%)

Al (aluminum) is an element which acts as a deoxidizing element. The Al content may also be 0%, but to obtain a sufficient deoxidizing effect, the Al content is preferably 0.0010% or more. The Al content is more preferably 0.0050% or more, further preferably 0.0100% or more, further more preferably 0.0150% or more. On the other hand, if the Al content is excessive, it is liable to trigger a reduction in the workability or a deterioration in surface properties. Therefore, the Al content is less than 0.4000%. The Al content may be 0.3900% or less, 0.3800% or less, 0.3700% or less, 0.3500% or less, 0.3400% or less, 0.3300% or less, 0.3000% or less, or 0.2000% or less. The Al content means the content of so-called acid-soluble Al (sol. Al).

(P: 0.0300% or Less)

P (phosphorus) is an impurity generally contained in steel. If excessively containing P, the weldability is liable to decline. Accordingly, the P content is 0.0300% or less. The P content is preferably 0.0200% or less, more preferably 0.0100% or less, even more preferably 0.0050% or less. The lower limit of the P content is 0%, but from the viewpoint of production costs, the P content may be more than 0% or be 0.0001% or more.

(S: 0.0300% or Less)

S (sulfur) is an impurity generally contained in steel. If excessively containing S, the weldability is liable to decline and further the amount of precipitated MnS is liable to increase and the bendability or other workability is liable to fall. Accordingly, the S content is 0.0300% or less. The S content is preferably 0.0100% or less, more preferably 0.0050% or less, even more preferably 0.0020% or less. The lower limit of the S content is 0%, but from the viewpoint of desulfurization costs, the S content may be more than 0% or be 0.00010% or more.

(N: 0.0100% or Less)

N (nitrogen) is an impurity generally contained in steel. If excessively containing N, the weldability is liable to decline. Accordingly, the N content is 0.0100% or less. The N content is preferably 0.0080% or less, more preferably 0.0050% or less, even more preferably 0.0030% or less. The lower limit of the N content is 0%, but from the viewpoint of production costs, the N content may be more than 0% or be 0.0010% or more.

The basic chemical composition of the steel sheet according to the present invention is as explained above. Furthermore the steel sheet may contain, in accordance with need, the following optional elements. Inclusion of these elements is not essential. The lower limits of contents of these elements are 0%.

(B: 0 to 0.010%)

B (boron) is an element which contributes to increasing hardenability and improving strength and further segregates at the grain boundaries to strengthen the grain boundaries and improve toughness. The B content may be 0%, but may be included in accordance with need so as to obtain the above effect. The B content may be 0.0001% or more, 0.0005% or more, or 0.001% or more. On the other hand, from the viewpoint of securing sufficient toughness and weldability, the B content is preferably 0.010% or less and may be 0.008% or less or 0.006% or less as well.

(Ti: 0 to 0.150%)

Ti (titanium) is an element which precipitates during cooling of steel as TiC and contributes to improving strength. The Ti content may be 0%, but may be included in accordance with need so as to obtain the above effect. The Ti content may be 0.001% or more, 0.003% or more, 0.005% or more, or 0.010% or more. On the other hand, if excessively containing Ti, coarse TiN is formed and the toughness is liable to be harmed. For this reason, the Ti content is preferably 0.150% or less and may also be 0.100% or less or 0.050% or less.

(Nb: 0 to 0.150%)

Nb (niobium) is an element which contributes to improving strength through improving hardenability. The Nb content may be 0%, but may be included in accordance with need so as to obtain the above effect. The Nb content may be 0.001% or more, 0.005% or more, 0.010% or more, or 0.015% or more. On the other hand, from the viewpoint of securing sufficient toughness and weldability, the Nb content is preferably 0.150% or less and may also be 0.100% or less or 0.060% or less.

(V: 0 to 0.150%)

V (vanadium) is an element which contributes to improving strength through improving hardenability. The V content may be 0%, but may be included in accordance with need so as to obtain the above effect. The V content may be 0.0010% or more, 0.010% or more, 0.020% or more, or 0.030% or more. On the other hand, from the viewpoint of securing sufficient toughness and weldability, the V content is preferably 0.150% or less and may be 0.100% or less or 0.060% or less.

(Cr: 0 to 2.00%)

Cr (chromium) is effective for increasing the hardenability of steel and increasing the strength of steel. The Cr content may be 0%, but may be included in accordance with need so as to obtain the above effect. The Cr content may be 0.01% or more, 0.10% or more, 0.20% or more, 0.50% or more, or 0.80% or more. On the other hand, if excessively containing Cr, Cr carbides are formed in a large amount and conversely the hardenability is liable to be harmed, so the Cr content is preferably 20.00% or less and may be 1.80% or less or 1.50% or less.

(Ni: 0 to 2.00%)

Ni (nickel) is an element effective for increasing the hardenability of steel and increasing the strength of steel. The Ni content may be 0%, but may be included in accordance with need so as to obtain the above effect. The Ni content may be 0.01% or more, 0.10% or more, 0.20% or more, 0.50% or more, or 0.80% or more. On the other hand, excessive increase of Ni invites a rise in costs. Therefore, the Ni content is preferably 20.00% or less and may also be 1.80% or less or 1.50% or less.

(Cu: 0 to 2.00%)

Cu (copper) is an element effective for increasing the hardenability of steel and increasing the strength of steel. The Cr content may be 0%, but may be included in accordance with need so as to obtain the above effect. The Cu content may be 0.001% or more, 0.005% or more, or 0.01% or more. On the other hand, from the viewpoint of suppressing a drop in toughness, cracking of slabs after casting, and a drop in weldability, the Cu content is preferably 2.00% or less and may be 1.80% or less, 1.50% or less, or 1.00% or less.

(Mo: 0 to 1.00%)

Mo (molybdenum) is an element effective for increasing the hardenability of steel and increasing the strength of steel. The Mo content may be 0%, but may be included in accordance with need so as to obtain the above effect. The Mo content may be 0.01% or more, 0.10% or more, 0.20% or more, or 0.30% or more. On the other hand, from the viewpoint of suppressing a drop in toughness and weldability, the Mo content is preferably 1.00% or less and may also be 0.90% or less or 0.80% or less.

(W: 0 to 1.00%)

W (tungsten) is an element effective for increasing the hardenability of steel and increasing the strength of steel. The W content may be 0%, but may be included in accordance with need so as to obtain the above effect. The W content may be 0.001% or more, 0.005% or more, or 0.01% or more. On the other hand, from the viewpoint of suppressing a drop in toughness and weldability, the W content is preferably 1.00% or less and may also be 0.90% or less, 0.80% or less, 0.50% or less, or 0.10% or less.

(Ca: 0 to 0.100%)

Ca (calcium) is an element contributing to inclusion control, particularly fine dispersion of inclusions, and has the action of increasing toughness. The Ca content may be 0%, but may be included in accordance with need so as to obtain the above effect. The Ca content may also be 0.0001% or more, 0.0005% or more, or 0.001% or more. On the other hand, if excessively containing Ca, degradation of the surface properties will sometimes appear. For this reason, the Ca content is preferably 0.100% or less and may be 0.080% or less, 0.050% or less, 0.010% or less, or 0.005% or less.

(Mg: 0 to 0.100%)

Mg (magnesium) is an element contributing to inclusion control, particularly fine dispersion of inclusions, and has the action of increasing toughness. The Mg content may be 0%, but may be included in accordance with need so as to obtain the above effect. The Mg content may also be 0.0001% or more, 0.0005% or more, or 0.001% or more. On the other hand, if excessively containing Mg, degradation of the surface properties will sometimes appear. For this reason, the Mg content is preferably 0.100% or less and may also be 0.090% or less, 0.080% or less, 0.050% or less, or 0.010% or less.

(Zr: 0 to 0.100%)

Zr (zirconium) is an element contributing to inclusion control, particularly fine dispersion of inclusions, and has the action of increasing toughness. The Zr content may be 0%, but may be included in accordance with need so as to obtain the above effect. The Zr content may also be 0.001% or more, 0.005% or more, or 0.010% or more. On the other hand, if excessively containing Zr, degradation of the surface properties will sometimes appear. For this reason, the Zr content is preferably 0.100% or less and may be 0.050% or less, 0.040% or less, or 0.030% or less.

(Hf: 0 to 0.100%)

Hf (hafnium) is an element contributing to inclusion control, particularly fine dispersion of inclusions, and has the action of increasing toughness. The Hf content may be 0%, but may be included in accordance with need so as to obtain the above effect. The Hf content may also be 0.0001% or more, 0.0005% or more, or 0.001% or more. On the other hand, if excessively containing Hf, degradation of the surface properties will sometimes appear. Therefore, the Hf content is preferably 0.100% or less and may be 0.050% or less, 0.030% or less, or 0.010% or less.

(REM: 0 to 0.100%)

A REM (rare earth element) is an element contributing to inclusion control, particularly fine dispersion of inclusions, and has the action of increasing toughness. The REM content may be 0%, but may be included in accordance with need so as to obtain the above effect. The REM content may also be 0.0001% or more, 0.0005% or more, or 0.001% or more. On the other hand, if excessively containing REM, degradation of the surface properties will sometimes appear.

For this reason, the REM content is preferably 0.100% or less and may also be 0.050% or less, 0.030% or less, or 0.010% or less. REM is an acronym for rare earth metals and indicates elements belonging to the lanthanide series. A REM is normally added as mischmetal.

In the steel sheet according to the present invention, the balance excluding the above chemical composition is comprised of Fe and impurities. Here, "impurities" mean constituents, etc., which enter from the ore, scraps, and other raw materials and various factors in the manufacturing process when industrially producing steel sheet.

In the present invention, the chemical composition of the steel sheet may be analyzed using an elemental analysis technique known to persons skilled in the art. For example, it is performed by inductively coupled plasma-mass spectroscopy (ICP-MS). However, C and S may be measured by combustion-infrared absorption, and N may be measured using inert gas fusion-thermal conductivity. These analyses may be performed on samples taken from the steel sheet by a method based on JIS G0417: 1999.

[Surface Layer]

In the present invention, the "surface layer" of the steel sheet means a region from the surface of the steel sheet (in the case of a plated steel sheet, the interface between the steel sheet and plating layer) to a predetermined depth in the thickness direction. The "predetermined depth" is typically 50 μm or less.

As shown in FIG. 2, the steel sheet 11 according to the present invention includes grain boundary oxides 13 in the surface layer of the steel sheet 11. Preferably, only the grain boundary oxides 13 are present. By the grain boundary oxides 13 being present inside of the base steel 14 (i.e., being present as internal oxides), it is possible for the steel sheet 11 to have high plateability compared to the case in which there is an external oxidation layer 2 on the surface of the steel sheet 1 shown in FIG. 1. This is believed to be a result of the fact that, in relation to the formation of internal oxides, there is no external oxidation layer present impeding interdiffusion of the plating constituents and steel constituents when forming plating (for example, Zn-based plating) on the surface of steel sheet or it is only present in a sufficiently thin thickness, so the plating constituents and steel constituents are sufficiently interdiffused. Accordingly, the steel sheet and plated steel sheet according to the present invention which include grain boundary oxides in the surface layer of the steel sheet, i.e., inside of the steel sheet, have high plateability.

Further, as shown in FIG. 2, in the steel sheet 11 according to the present invention, the surface layer of the steel sheet 11 may also contain granular oxides 12 in addition to the grain boundary oxides 13. The granular oxides 12 are present at the inside of the base steel 14 in the same way as the grain boundary oxides 13, so the steel sheet and plated steel sheet containing both granular oxides 12 and grain boundary oxides 13 also have high plateability. On the other hand, granular oxides 12 are present as respectively independent grains, so do not function as escape routes for hydrogen at the time of annealing. Rather, if excessively present, they sometimes trap hydrogen trying to escape so the hydrogen discharge function of the grain boundary oxides 13 can be lowered. Further, if the steel sheet 11 is produced using production conditions (in particular, the annealing conditions) where the granular oxides 12 are excessively formed (for example, with the later explained number density of 4.0/μm$^2$, or more), formation of granular oxides 12 is promoted, grain boundary oxides 13 are not sufficiently formed, and the hydrogen discharge function tends to easily fall. Therefore, from the viewpoint of effectively increasing the escape routes for hydrogen at the time of annealing, the granular oxides 12 are preferably as few as possible. Therefore, more preferably, in the present invention, granular oxides 12 need not be included in the surface layer of the steel sheet 11 (i.e., all of the oxides present at the surface layer of the steel sheet 11 may be grain boundary oxides 13).

[Granular Oxides]

In the present invention, "granular oxides" mean oxides dispersed as grains inside the crystal grains of the steel or on the crystal grain boundaries. Furthermore, "granular" means being present away from each other mutually in the steel matrix, having, for example, a 1.0 to 5.0 aspect ratio (maximum linear length (major diameter) traversing the granular oxide/maximum linear length (minor diameter) traversing the oxide perpendicular to the major diameter). "Dispersed as grains" means that the grains of oxides are not positioned according to a specific rule (for example, linearly) but are positioned randomly. Since granular oxides are in fact typically present three-dimensionally in spherical shapes or substantially spherical shapes in the surface layer of the steel sheet, the granular oxides are typically observed to have circular shapes or substantially circular shapes when a cross-section of the surface layer of the steel sheet is observed. In FIG. 2, as an example, granular oxides 12 appearing to be substantially circular are shown. The average grain size of the granular oxides 12 is not particularly limited, but for example may be 300 nm or less, 200 nm or less, or 150 nm or less.

(Number Density)

In the present invention, the number density of granular oxides is less than 4.0/μm$^2$. In the steel sheet in the present invention, granular oxides need not be included in the surface layer of the steel sheet, so the number density may also be 0/μm$^2$. Granular oxides function as trap sides for hydrogen and thereby are liable to impede the escape of hydrogen in the steel. Therefore, in particular from the viewpoint of improving the hydrogen disperseability, granular oxides are preferably fewer in number. The number density is less than 4/μm$^2$. Further, from the viewpoint of obtaining excellent hydrogen dischargeability, the number density is preferably less than 3.0/μm$^2$, more preferably less than 2.0/μm$^2$, still more preferably less than 1.0/μm$^2$.

The average grain size and number density of the fine granular oxides are measured by a scan electron microscope (SEM). The specific measurement is as follows: A cross-section of the surface layer of the steel sheet is examined by a SEM and a SEM image including the granular oxides is obtained. From the SEM image, as examined regions, a total of 10 regions of 1.0 μm (depth direction)×1.0 μm (width direction) are selected. The examined position of each region is made 1.0 μm in the region from the steel sheet surface to 1.5 μm for the depth direction (direction vertical to surface of steel sheet) and is made 1.0 μm at any position of the SEM image for the width direction (direction parallel to surface of steel sheet). If granular oxides are not observed at the examined region, the number density is 0/μm$^2$. In that case, there is no average grain size. Next, SEM images of the regions selected in the above way are extracted and digitalized to divide them into oxide parts and steel parts. From the digitalized images, the area of each granular oxide part is calculated. Further, the number of granular oxides in each digitalized image is counted. From the total area and number of granular oxides of the total of regions in the 10 locations found in this way, the average grain size (nm) of the granular oxides is found as the circle equivalent diameter. Further, the number density of granular oxides (/$\mu m^2$) is equal to the average value of the numbers of granular oxides counted from the digitalized images. If only parts of the granular oxides are observed in the examined regions, i.e., if not all of the contours of the granular oxides are inside the examined regions, they are not counted in the numbers. Further, from the viewpoint of the measurement precision, the lower limit counted as the number of granular oxides is 5.0 nm is more.

[Grain Boundary Oxides]

Figure 3:
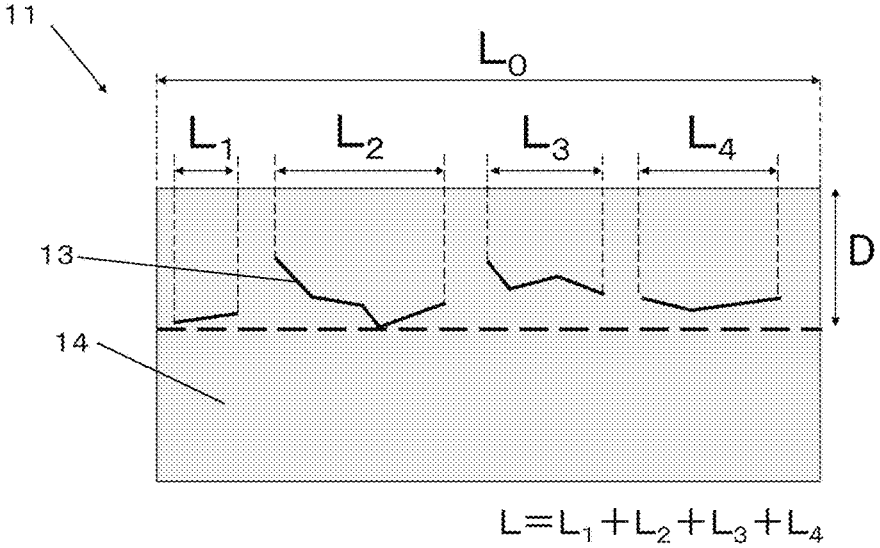
FIG. 3 is a schematic view for explaining measurement of the Ratio A in the present invention.

In the present invention, "grain boundary oxides" means oxides present along the crystal grain boundaries of the steel. Oxides present inside the crystal grains of the steel are not included. In actuality, the grain boundary oxides are present in planar shapes so as to run along the crystal grain boundaries at the surface layer of the steel sheet, so when examining a cross-section of the surface layer of a steel sheet, such grain boundary oxides are observed in line shapes. In FIG. 2 and FIG. 3, as examples, grain boundary oxides 13 appearing as line shapes are shown. Further, in FIG. 2 and FIG. 3, as a typical example of the steel sheet 11, grain boundary oxides 13 are shown below the granular oxides 12, but grain boundary oxides 13 are also formed near the surface of the base steel 14. Due to the formation of the grain boundary oxides 13 near the surface of the steel sheet, the steel sheet surface and inside of the steel sheet are connected by the grain boundary oxides and the hydrogen discharge function is sufficiently exhibited.

(Ratio A)

In the present invention, the "Ratio A", as shown in FIG. 3, means the ratio of the "length L ($=L_1+L_2+L_3+L_4$) of grain boundary oxides projected on the surface of the steel sheet to the length $L_0$ of the surface of the steel sheet" at the examined image in the case of examining the cross-section of the surface layer of the steel sheet 11. In the present invention, the Ratio A is 50% or more and 100% or less. By controlling the Ratio A to such a range, it is possible to make the grain boundary oxides form over a broad range inside of the steel sheet. The grain boundary oxides function well as escape routes for hydrogen. On the other hand, if the Ratio A is less than 50%, they do not sufficiently function as escape routes for hydrogen and excellent hydrogen dischargeability is liable to be unable to obtain. The Ratio A is preferably 60% or more, more preferably 70% or more, still more preferably 80% or more, still more preferably 90% or more. The Ratio A may also be 100%.

The Ratio A, as shown in FIG. 3, is determined by examining the cross-section of the surface layer of the steel sheet 11. The specific measurement method is as follows: The cross-section of the surface layer of the steel sheet 11 is examined by a SEM. The observed position is made a randomly selected location. From the observed SEM image, the length $L_0$ of the surface (i.e., the width of the SEM image) is measured. The length $L_0$ is made 100 μm or more (for example, 100 μm, 150 μm, or 200 μm) while the depth measured is made the region from the surface of the steel sheet down to 50 μm. Next, the position of the grain boundary oxides 13 from the SEM image is identified, the identified grain boundary oxides 13 are projected on the surface of the steel sheet 11 (in the case of a plated steel sheet, on the interface of the steel sheet 11 and plating layer), and the length L of the grain boundary oxides 13 in the field ($=L_1+L_2+L_3+L_4$) is found. Based on the thus found $L_0$ and L, the ratio A (%) in the present invention=$100\times L/L_0$ is found. FIG. 3 is a view eliminating the granular oxides 12 for explanation.

[Chemical Composition of Oxides]

In the present invention, the granular oxides and optional grain boundary oxides (below, also referred to simply as "oxides") include one or more of the above-mentioned elements included in the steel sheet in addition to oxygen and typically have chemical compositions including Si, O, and Fe and in some cases further including Mn. More specifically, the oxides typically contain Si: 5 to 25%, Mn: 0 to 10%, O: 40 to 65%, and Fe: 10 to 30%. The oxides may also contain elements able to be included in the above-mentioned steel sheet (for example, Cr, etc.) in addition to these elements.

[Si—Mn Depleted Layer]

The steel sheet according to the present invention contains an Si—Mn depleted layer having a thickness of 3.0 μm or more from the surface of the steel sheet. The contents of Si and Mn of the Si—Mn depleted layer not containing oxides at the ½ position of that thickness are respectively less than 10% of the contents of Si and Mn at the sheet thickness center part of the steel sheet. By making the Si—Mn depleted layer formed at the surface layer of the steel sheet due to the formation of the grain boundary oxides and/or granular oxides a thickness of 3.0 μm or more and controlling the Si and Mn depletion rates of the Si—Mn depleted layer respectively less than 10%, it is possible to sufficiently reduce the amounts of dissolved Si and Mn impeding diffusion of hydrogen. As a result, it becomes possible to promote diffusion of hydrogen. Therefore, by combining the above-mentioned grain boundary oxides and Si—Mn depleted layer, it is possible to remarkably improve the dischargeability of hydrogen. Further, by making the thickness of the Si—Mn depleted layer greater, it is possible to promote more the diffusion of hydrogen from inside the steel, so the thickness of the Si—Mn depleted layer is preferably 4.0 μm or more, more preferably 5.0 μm or more, most preferably 7.0 μm or more. The upper limit of thickness of the Si—Mn depleted layer is not particularly limited, but for example the thickness of the Si—Mn depleted layer may be 50.0 μm or less.

Similarly, by making the Si and Mn depletion rates of the Si—Mn depleted layer smaller, it is possible to further reduce the amounts of dissolved Si and Mn in the steel. For this reason, the Si depletion rate of the Si—Mn depleted layer is preferably 8% or less, more preferably 6% or less, most preferably 4% or less. The lower limit of the Si depletion rate is not particularly prescribed, but may be 0%. Similarly, the Mn depletion rate of the Si—Mn depleted layer is preferably 8% or less, more preferably 6% or less, most preferably 4% or less. The lower limit of the Mn depletion rate is not particularly prescribed, but may be 0%. In the present invention, the expression "not containing oxides" means not containing not only the above grain boundary oxides and granular oxides, but also any other oxides. Such a region not containing oxides can be identified by examination of the cross-section by a SEM and energy dispersed X-ray spectroscopy (EDS). Further, the Si—Mn depleted layer according to the present invention cannot be controlled to the desired ranges of thickness and composition just by forming grain boundary oxides and other internal oxides. As explained in detail later, it becomes important to suitably control the progression of internal oxidation in the production process.

The thickness of the Si—Mn depleted layer, as shown by D in FIG. 3, means the distance from the surface of the steel sheet 11 to the furthest position where a grain boundary oxide 13 is present when proceeding from the surface of the steel sheet 11 (in the case of a plated steel sheet, the interface of the steel sheet and plating layer) in the thickness direction of the steel sheet 11 (direction vertical to surface of steel sheet). The thickness of the Si—Mn depleted layer may be found from the same image as the SEM image used for measuring the above-mentioned Ratio A (length $L_0$ of surface). Further, the Si and Mn contents of the region not containing oxides at the ½ position of thickness of the Si—Mn depleted layer are determined by analyzing points of 10 locations not containing oxides randomly selected at ½ position of thickness of the Si—Mn depleted layer determined from the SEM image by a transmission electron microscope with an energy dispersed X-ray spectroscope (TEM-EDS) and obtaining the arithmetic averages of the obtained measured values of the Si and Mn concentrations. Further, the Si and Mn contents at the sheet thickness center part of the steel sheet are determined by examining the cross-section of the sheet thickness center part by a SEM, analyzing points of 10 locations randomly selected at the sheet thickness center part from the SEM image by a transmission electron microscope with an energy dispersed X-ray spectroscope (TEM-EDS), and obtaining the arithmetic averages of the obtained measured values of the Si and Mn concentrations. Finally, the values of the Si and Mn contents at the ½ position of thickness of the Si—Mn depleted layer divided by the Si and Mn contents at the sheet thickness center part of the steel sheet and expressed as percentages are determined as the Si and Mn depletion rates.

<Plated Steel Sheet>

The plated steel sheet according to the present invention has a plating layer containing Zn on the above-mentioned steel sheet according to the present invention. This plating layer may be formed on one side of the steel sheet or may be formed on both sides. As the plating layer containing Zn, for example, a hot dip galvanized layer, hot dip galvannealed layer, electrogalvanized layer, electrogalvannealed layer, etc., may be mentioned. More specifically, as the plating type, for example, Zn-0.2% Al (GI), Zn-(0.09% Al (GA), Zn-1.5% Al-1.5% Mg, or Zn-11% Al-3% Mg-0.2% Si, etc., can be used.

[Chemical Composition of Plating Layer]

The chemical composition included in a plating layer containing Zn in the present invention will be explained next. The "%" regarding content of the elements, unless otherwise stated, will mean "mass %". In the numerical ranges in the chemical composition of the plating layer, a numerical range expressed using "to", unless otherwise indicated, will mean a range having the numerical values before and after the "to" as the lower limit value and the upper limit value.

(Al: 0 to 60.0%)

Al is an element which is included together with Zn or is alloyed with it and improves the corrosion resistance of the plating layer, so may be included in accordance with need. Therefore, the Al content may be 0%. To form a plating layer containing Zn and Al, preferably the Al content is 0.01% or more. For example, it may be 0.1% or more, 0.5% or more, 1.0% or more, or 3.0% or more. On the other hand, even if excessively containing Al, the effect of improvement of the corrosion resistance becomes saturated, so the Al content is preferably 60.0% or less. For example, it may be 55.0% or less, 50.0% or less, 40.0% or less, 30.0% or less, 20.0% or less, 10.0% or less, or 5.0% or less.

(Mg: 0 to 15.0%)

Mg is an element which is included together with Zn and Al or is alloyed with the same and improves the corrosion resistance of the plating layer, so may be included in accordance with need. Therefore, the Mg content may be 0%. To form a plating layer containing Zn, Al, and Mg, preferably the Mg content is 0.01% or more. For example, it may be 0.1% or more, 0.5% or more, 1.0% or more, or 3.0% or more. On the other hand, if excessively containing Mg, the Mg will not completely dissolve in the plating bath but will float as oxides. If galvanizing by such a plating bath, oxides will deposit on the surface layer causing poor appearance or liable to cause the occurrence of non-plated parts. For this reason, the Mg content is preferably 15.0% or less, for example, may be 10.0% or less or 5.0% or less.

(Fe: 0 to 15.0%)

Fe can be included in the plating layer due to diffusion from the steel sheet when forming a plating layer containing Zn on the steel sheet, then heat treating the plated steel sheet. Therefore, Fe is not included in the plating layer in a state not treated by heat, so the Fe content may also be 0%. Further, the Fe content may be 1.0% or more, 2.0% or more, 3.0% or more, 4.0% or more, or 5.0% or more. On the other hand, the Fe content is preferably 15.0% or less, for example, may be 12.0% or less, 10.0% or less, 8.0% or less, or 6.0% or less.

(Si: 0 to 3.0%)

Si is an element which further improves the corrosion resistance if included in a plating layer containing Zn, in particular a Zn—Al—Mg plating layer, so may be included in accordance with need. Therefore, the Si content may be 0%. From the viewpoint of improvement of the corrosion resistance, the Si content may for example be 0.005% or more, 0.01% or more, 0.05% or more, 0.1% or more, or 0.5% or more. Further, the Si content may be 3.0% or less, 2.5% or less, 2.0% or less, 1.5% or less, or 1.2% or less.

The basic chemical composition of the plating layer is as explained above. Furthermore the plating layer may contain, optionally, one or more of Sb: 0 to 0.50%, Pb: 0 to 0.50%, Cu: 0 to 1.00%, Sn: 0 to 1.00%, Ti: 0 to 1.00%, Sr: 0 to 0.50%, Cr: 0 to 1.00%, Ni: 0 to 1.00%, and Mn: 0 to 1.00%. While not particularly limited, from the viewpoint of sufficiently manifesting the actions and functions of the basic constituents forming the plating layer, the total content of these optional elements is preferably made 5.00% or less, more preferably 2.00% or less.

At the plating layer, the balance besides the above constituents is comprised of Zn and impurities. The "impurities at the plating layer" mean constituents such as the raw material entering due to various factors in the production process when producing the plating layer. In the plating layer, as impurities, elements besides the basic constituents and optional constituents explained above may be included in trace amounts in a range not impeding the effect of the present invention.

The chemical composition of the plating layer can be determined by dissolving the plating layer in an acid solution containing an inhibitor for inhibiting corrosion of the steel sheet and measuring the obtained solution by ICP (inductively coupled plasma) emission spectroscopy.

The thickness of the plating layer may for example be 3 to 50 μm. Further, the amount of deposition of the plating layer is not particularly limited but for example may be 10 to 170 g/m$^2$ per side. In the present invention, the amount of deposition of the plating layer is determined by dissolving the plating layer in an acid solution containing an inhibitor for inhibiting corrosion of the base iron and finding the change in weight before and after pickling.

[Tensile Strength]

The steel sheet and plated steel sheet according to the present invention preferably have a high strength. Specifically, they preferably have 440 MPa or more tensile strength.

For example, the tensile strength may be 500 MPa or more, 600 MPa or more, 700 MPa or more, or 800 MPa or more. The upper limit of the tensile strength is not particularly prescribed, but from the viewpoint of securing toughness, may for example be 2000 MPa or less. The tensile strength may be measured by taking a JIS No. 5 tensile test piece having a direction vertical to the rolling direction as its longitudinal direction and performing a test based on JIS Z 2241(2011).

The steel sheet and plated steel sheet according to the present invention are high in strength and have a high plateability and hydrogen dischargeability, so can be suitably used in a broad range of fields such as automobiles, household electric appliances, and building materials, but are particularly preferably used in the automotive field. Steel sheet used for automobiles usually is plated (typically Zn-based plating), so if using the steel sheet according to the present invention as steel sheet for automobiles, the effect of the present invention of having a high plateability is optimally exhibited. Further, steel sheet and plated steel sheet used for automobiles are often hot stamped. In that case, hydrogen embrittlement cracking can become a remarkable problem. Therefore, when using the steel sheet and plated steel sheet according to the present invention as steel sheet for automobiles, the effect of the present invention of having a high hydrogen dischargeability is optimally exhibited.

<Method of Production of Steel Sheet>

Below, a preferable method of production of the steel sheet according to the present invention will be explained. The following explanation is intended to illustrate the characteristic method for producing the steel sheet according to the present invention and is not intended to limit the steel sheet to one produced by the method of production explained below.

The steel sheet according to the present invention can be obtained for example by performing a casting step of casting molten steel adjusted in chemical composition to form a steel slab, a hot rolling step of hot rolling the steel slab to obtain hot rolled steel sheet, a coiling step of coiling the hot rolled steel sheet, a cold rolling step of cold rolling the coiled hot rolled steel sheet to obtain cold rolled steel sheet, a grinding step of introducing dislocations into the surface of the cold rolled steel sheet, and an annealing step of annealing the ground cold rolled steel sheet. Alternatively, the hot rolled steel sheet may not be coiled after the hot rolling step, but pickled and then cold rolled as it is.

[Casting Step]

The conditions of the casting step are not particularly prescribed. For example, after smelting by a blast furnace or electric furnace, etc., various secondary refining operations may be performed, then the molten metal cast by the usual continuous casting, ingot casting, or other method.

[Hot Rolling Step]

The thus cast steel slab can be hot rolled to obtain hot rolled steel sheet. The hot rolling step is performed by directly hot rolling the cast steel slab or by reheating after cooling once. If reheating, the heating temperature of the steel slab may for example be 1100° C. to 1250° C. In the hot rolling step, usually rough rolling and finish rolling are performed. The temperatures and rolling reductions of the rolling operations may be suitably changed in accordance with the desired metallographic structure and sheet thickness. For example, the end temperature of the finish rolling may be made 900 to 1050° C. and the rolling reduction of the finish rolling may be made 10 to 50%.

[Coiling Step]

The hot rolled steel sheet can be coiled at a predetermined temperature. The coiling temperature may be suitably changed in accordance with the desired metallographic structure, etc., and may for example be 500 to 800° C. The hot rolled steel sheet may be heat treated under predetermined conditions before being coiled or after being coiled by being uncoiled. Alternatively, the sheet can be pickled after the hot rolling step without performing a coiling step and then subjected to a later explained cold rolling step.

[Cold Rolling Step]

After pickling the hot rolled steel sheet, the hot rolled steel sheet can be cold rolled to obtain cold rolled steel sheet. The rolling reduction of the cold rolling may be suitably changed in accordance with the desired metallographic structure and sheet thickness and may for example be 20 to 80%. After the cold rolling step, for example, the sheet may be air cooled to cool it down to room temperature.

[Grinding Step]

To sufficiently cause the formation of grain boundary oxides at the surface layer of the finally obtained steel sheet and further to cause the formation of an Si—Mn depleted layer having the desired thickness and composition, it is effective to perform a grinding step before annealing the cold rolled steel sheet. Due to that grinding step, it is possible to introduce a large amount of dislocations to the surface of the cold rolled steel sheet. Oxygen, etc., diffuse faster at the grain boundaries than inside the grains, so by introducing a large amount of dislocations to the surface of the cold rolled steel sheet, it is possible to form a large number of paths in the same way as the case of grain boundaries. For this reason, at the time of annealing, oxygen easily diffuses (penetrates) to the inside of the steel along these dislocations and the speeds of diffusion of Si and Mn are also improved, so as a result, the oxygen bonds with the Si and/or Mn inside of the steel and formation of grain boundary oxides can be promoted. Further, along with promotion of formation of such internal oxides, the drop in the concentrations of Si and Mn in the surroundings is also promoted, so it is also possible to promote the formation of an Si—Mn depleted layer having the desired thickness and composition. The grinding step is not particularly limited, but for example can be performed by using a heavy duty grinding brush to grind the surface of cold rolled steel sheet under conditions of an amount of grinding of 10 to 200 g/m$^2$. The amount of grinding by the heavy duty grinding brush can be adjusted by any suitable method known to persons skilled in the art. While not particularly limited, for example, it can be adjusted by suitably selecting the number, speed, brushing pressure, coating solution used, etc., of the heavy duty grinding brush. By performing such a grinding step, in the later explained annealing step, it becomes possible to form the desired granular oxides and optional grain boundary oxides and possible to reliably and efficiently form an Si—Mn depleted layer having the desired thickness and composition, i.e., having a 3.0 μm or more thickness and having Si and Mn depletion rates of respectively less than 10%, at the surface layer of the steel sheet.

[Annealing Step]

The cold rolled steel sheet subjected to the above grinding step is annealed. The annealing is preferably performed in a state in which tension is applied to the cold rolled steel sheet in the rolling direction. In particular, in a region where the annealing temperature is 500° C. or more, it is preferable to raise the tension in performing the annealing compared with other regions. Specifically, in a region where the annealing temperature is 500° C. or more, it is preferable to perform the annealing in a state applying 3 to 150 MPa, in particular 15 to 150 MPa of tension to the cold rolled steel sheet in the rolling direction. If applying tension at the time of annealing, a large amount of dislocations can be more effectively introduced to the surface of the cold rolled steel sheet. Therefore, at the time of annealing, it is made easier for oxygen to diffuse to (penetrate) the inside of the steel along those dislocations and the speeds of diffusion of Si and Mn are also improved, so oxides become easier to form inside the steel sheet. As a result, this is advantageous for formation of the desired ratio of the grain boundary oxides and formation of the Si—Mn depleted layer having the desired thickness and composition.

From the viewpoint of making the grain boundary oxides form at the surface layer of the steel sheet and raising the Ratio A, the holding temperature of the annealing step is preferably more than 780° C. to 900° C., more preferably 800 to 850° C. If the holding temperature of the annealing step is 780° C. or less, sometimes the formation of the grain boundary oxides will become insufficient and the hydrogen discharge function will fall. On the other hand, if the holding temperature of the annealing step is more than 900° C., an external oxidation layer is liable to be formed at the surface of the steel sheet and the plateability to become insufficient. The temperature elevation rate up to the holding temperature is not particularly limited, but may be 1 to 10° C./s. Further, the temperature elevation may be performed in two stages by a first temperature elevation rate of 1 to 10° C./s and a second temperature elevation rate of 1 to 10° C./s different from the first temperature elevation rate.

The holding time at the holding temperature is preferably 10 to 50 seconds, more preferably 30 to 50 seconds. If the holding time is less than 10 seconds, the grain boundary oxides are liable to not be sufficiently formed and sometimes the plateability and hydrogen dischargeability will become insufficient. On the other hand, if the holding time is more than 50 seconds, the granular oxides are liable to become excessively formed and sometimes the hydrogen dischargeability will become insufficient.

From the viewpoint of causing the formation of grain boundary oxides over a broad range (by a high Ratio A), the dew point of the atmosphere in the annealing step is preferably −20 to 10° C., more preferably −10 to 5° C. If the dew point is too low, an external oxidation layer is liable to be formed on the surface of the steel sheet and internal oxides liable to not be sufficiently formed. The plateability and hydrogen dischargeability will sometimes become insufficient. On the other hand, if the dew point is too high, Fe oxides will form as external oxides on the steel sheet surface and the plateability is liable to become insufficient. Further, the atmosphere in the annealing step more specifically may be a reducing atmosphere containing nitrogen and hydrogen, for example, a reducing atmosphere of hydrogen in 1 to 10% (for example, hydrogen 4% and balance of nitrogen).

Furthermore, it is effective to remove the internal oxidation layer of the steel sheet when performing the annealing step. During the above-mentioned rolling step, in particular the hot rolling step, sometimes an internal oxidation layer is formed at the surface layer of the steel sheet. Such an internal oxidation layer formed in a rolling step is liable to inhibit the formation of sufficient grain boundary oxides at the annealing step, so that internal oxidation layer is preferably removed before annealing by pickling, etc. More specifically, the depth of the internal oxidation layer of the cold rolled steel sheet when performing an annealing step may be 0.5 μm or less, preferably 0.3 μm or less, more preferably 0.2 μm or less, still more preferably 0.1 μm or less.

By performing the steps explained above, it is possible to obtain steel sheet comprised of steel sheet with a surface layer at which grain boundary oxides are formed over a broad range (high Ratio A), formation of granular oxides is sufficiently suppressed, and an Si—Mn depleted layer having a desired thickness and composition is provided.

If providing a step, as a stage before the annealing step, of oxidizing and then reducing the steel in the oxidation zone by a 0.9 to 1.4 air ratio or air-fuel ratio, the Ratio A of length of the grain boundary oxides becomes less than 50%, so the grain boundary oxides do not sufficiently function as escape routes for hydrogen and good hydrogen dischargeability becomes difficult to obtain.

<Method of Production of Plated Steel Sheet>

Below, a preferable method of production of the plated steel sheet according to the present invention will be explained. The following explanation is intended to illustrate the characteristic method for producing the plated steel sheet according to the present invention and is not intended to limit the plated steel sheet to one produced by the method of production explained below.

The plated steel sheet according to the present invention can be obtained by performing a plating step for forming a plating layer containing Zn on the steel sheet produced in the above way.

[Plating Step]

The plating step may be performed according to a method known to persons skilled in the art. The plating step may for example be performed by hot dip coating and may be performed by electroplating. Preferably, the plating step is performed by hot dip coating. The conditions of the plating step may be suitably set considering the chemical composition, thickness, amount of deposition, etc., of the desired plating layer. After the plating, alloying may be performed. Typically, the conditions of the plating step may be set so as to form a plating layer containing Al: 0 to 60.0%, Mg: 0 to 15.0%, Fe: 0 to 15%, and Si: 0 to 3% and having a balance of Zn and impurities. More specifically, the conditions of the plating step may for example be suitably set so as to form for example Zn-0.2% Al (GI), Zn-0.09% Al (GA), Zn-1.5% Al-1.5% Mg, or Zn-11% Al-3% Mg-0.2% Si.

EXAMPLES

Below, examples will be used to explain the present invention in more detail, but the present invention is not limited to these examples in any way.

(Preparation of Steel Sheet Samples)

Molten steels adjusted in chemical compositions were cast to form steel slabs. The steel slabs were hot rolled, pickled, then cold rolled to obtain cold rolled steel sheets. Next, the sheets were air-cooled down to room temperature. The cold rolled steel sheets were pickled, then the internal oxidation layers formed by rolling were removed down to the internal oxidation layer depth (μm) before annealing described in Table 1. Next, samples were taken from the cold rolled steel sheets by the method based on JIS G0417: 1999 and the chemical compositions of the steel sheets were analyzed by ICP-MS, etc. The measured chemical compositions of the steel sheets are shown in Table 1. The thicknesses of the steel sheets used were 1.6 mm in all cases.

Next, each of the cold rolled steel sheets was coated with an NaOH aqueous solution, then the surface of the cold rolled steel sheet was ground using a heavy duty grinding brush by an amount of 10 to 200 g/m$^2$ (Sample No. 135 no grinding). After that, each was annealed by the dew point, holding temperature, and holding time shown in Table 1

(annealing atmosphere: hydrogen 4% and balance of nitrogen) to prepare each steel sheet sample. In all of the steel sheet samples, the temperature elevation rate at the time of annealing was made 6.0° C./s up to 500° C. and was made 2.0° C./s from 500° C. to the holding temperature. In the above annealing, the cold rolled steel sheet was annealed in the state applying 1 MPa or more of tension in the rolling direction. In the region of an annealing temperature of 500° C. or more, compared with other regions, the annealing was performed in the state applying a higher tension in the rolling direction, specifically a tension of 3 to 150 MPa (in Sample No. 134, such tension not applied). The presence of any grinding by a heavy duty grinding brush and the conditions of the annealing (presence of application of tension of 3 to 150 MPa, dew point (° C.), holding temperature (° C.), and holding time (s) in region with annealing temperature of 500° C. or more) are shown in Table 1. In each steel sheet sample, a JIS No. 5 tensile test piece having a direction vertical to the rolling direction as its longitudinal direction was taken. A tensile test was performed based on JIS Z 2241(2011). As a result, in Nos. 16 and 18, the tension strengths were less than 440 MPa, while in the others, they were 440 MPa or more.

(Analysis of Surface Layer of Steel Sheet Samples)

Each steel sheet sample prepared in the above way was cut to 25 mm×15 mm. The cut sample was buried in a resin and polished to a mirror surface. At the cross-section of each steel sheet sample, 1.0 μm×1.0 μm regions were examined by a SEM at 10 locations. The examined positions were made the 1.0 μm from 0.2 to 1.2 μm from the steel sheet surface for the depth direction (direction vertical to surface of steel sheet) and 1.0 μm of any position of the SEM image for the width direction (direction parallel to surface of steel sheet). As the regions, regions not containing grain boundary oxides were selected. Next, the SEM images of the regions of the steel sheet samples obtained were digitalized, the areas of the granular oxide parts were calculated from the digitalized images, and further the numbers of the granular oxides in the SEM images were counted. From the areas and numbers of granular oxides at the 10 digitalized images found in this way, the average grain size as the circular equivalent diameter and number density of the granular oxides were found. The average grain size (nm) and number density (/$\mu m^2$) of the granular oxides of the steel sheet samples are shown in Table 1. In Table 1, if there are no granular oxides in the SEM image (case where number density=0), the average grain size was described as "-".

Further, the Ratio A for each steel sheet sample was measured from examination of the cross-section of the above buried sample. Specifically, in a 150 μm width ($=L_0$) SEM image, the positions of grain boundary oxides were identified, the identified grain boundary oxides were projected on the surface of the steel sheet, and the lengths L of the grain boundary oxides in the field were found. Based on the $L_0$ and L found in this way, the Ratio A (%)=$100 \times L/L_0$ was found. The ratio A (%) of granular oxides for each steel sheet sample is shown in Table 1.

The thickness of the Si—Mn depleted layer was determined in the SEM image for which the Ratio A was measured by measuring the distance from the surface of the steel sheet to the furthest position where grain boundary oxides are present when proceeding from the surface of the steel sheet in the thickness direction of the steel sheet (direction vertical to surface of steel sheet). Further, the Si and Mn contents of the region not containing oxides at the ½ position of thickness of the Si—Mn depleted layer are determined by analyzing points of 10 locations not containing oxides randomly selected at ½ position of thickness of the Si—Mn depleted layer determined from the SEM image by a TEM-EDS and obtaining the arithmetic averages of the obtained measured values of the Si and Mn concentrations. Further, the Si and Mn contents at the sheet thickness center part of the steel sheet are determined by examining the cross-section of the sheet thickness center part by a SEM, analyzing points of 10 locations randomly selected at the sheet thickness center part from the SEM image by a TEM-EDS, and obtaining the arithmetic averages of the obtained measured values of the Si and Mn concentrations. Finally, the values of the Si and Mn contents at the ½ position of thickness of the Si—Mn depleted layer divided by the Si and Mn contents at the sheet thickness center part of the steel sheet and expressed as percentages are determined as the Si and Mn depletion rates. Further, each steel sheet sample was analyzed for chemical compositions of the granular oxides and grain boundary oxides, whereupon each of the oxides contained Si, O, and Fe and numerous oxides further contained Mn. The chemical composition of each of the oxides also contained Si: 5 to 25%, Mn: 0 to 10%, O: 40 to 65%, and Fe: 10 to 30%.

(Preparation of Samples of Plated Steel Sheet)

Each of the samples of steel sheets of Example 1 was cut to 100 mm×200 mm size, then was plated for forming the plating type shown in Table 1 to thereby prepare a sample of the plated steel sheet. In Table 1, the plating type A means "GA (hot dip galvannealed steel sheet)", the plating type B means "GI (hot dip galvanized steel sheet)", and the plating type C means "Zn-1.5% Al-1.5% Mg". In the hot dip galvanization step, the cut sample was dipped in a 440° C. hot dip galvanization bath for 3 seconds. After dipping, it was pulled out at 100 mm/s. $N_2$ wiping gas was used to control the amount of plating deposition to 50 g/$m^2$. For the plating type A, alloying was performed after that at 460° C.

(Evaluation of Plateability)

Each plated steel sheet sample was measured for area ratio of non-plated parts on the surface of that steel sheet so as to evaluate the plateability. Specifically, a 1 mm×1 mm region of the surface of each plated steel sheet sample formed with the plating layer was examined under an optical microscope, parts at which the plating layer was formed (plated parts) and parts where the plating layer was not formed (non-plated parts) were judged from the examined image, the area ratio of the non-plated parts (area of non-plated parts/area of observed image) was calculated, and the plateability was evaluated by the following criteria. The results are shown in Table 1. "Good" is passing and "Poor" is failing.

Evaluation Good: 5.0% or less

Evaluation Poor: more than 5.0%

(Evaluation of Hydrogen Dischargeability)

The edge parts of the plated steel sheet samples were masked and hydrogen was charged electrochemically into the plated steel sheet samples. The hydrogen was charged by dipping each sample in a mixed solution of 0.1M-$H_2SO_4$ (pH=3) and 0.01M-KSCN under conditions of room temperature and a constant current (100 μA/mm$^2$). After that, each plated steel sheet was measured for the amount of diffusible hydrogen by the thermal desorption method. Specifically, the plated steel sheet sample was heated to 400° C. in a heating furnace provided with a gas chromatography device. The sum of the amount of hydrogen discharged until falling to 250° C. was measured. Based on the measured amount of diffusible hydrogen, the hydrogen dischargeability was evaluated by the following criteria. The results are shown in Table 1. VG (very good) and G (good) are passing and P (poor) is failing.

Evaluation VG: 0.2 ppm or less

Evaluation G (good): more than 0.2 ppm and 0.4 ppm or less

Evaluation X (poor): more than 0.4 ppm

TABLE 1

| | | Chemical composition (mass %) | | | | | | | | | Depth of internal oxidation layer before annealing | Grinding (heavy duty grinding |
|---|---|---|---|---|---|---|---|---|---|---|---|---|
| No. | Class | Fe | C | Si | Mn | Al | P | S | N | Others | (μm) | brush) |
| 1 | Comp. ex. | Bal. | 0.05 | 1.6 | 2.0 | 0.0200 | 0.0090 | 0.0013 | 0.0024 | | **2.4** | Yes |
| 2 | Ex. | Bal. | 0.05 | 1.1 | 2.0 | 0.0150 | 0.0060 | 0.0150 | 0.0039 | REM: 0.004 | 0.1 | Yes |
| 3 | Ex. | Bal | 0.05 | 2.0 | 2.0 | 0.1200 | 0.0120 | 0.0012 | 0.0021 | | 0.1 | Yes |
| 4 | Ex. | Bal. | 0.10 | 0.5 | 2.0 | 0.0120 | 0.0080 | 0.0025 | 0.0031 | Hf: 0.003 | 0.2 | Yes |
| 5 | Ex. | Bal. | 0.10 | 1.5 | 2.0 | 0.0240 | 0.0120 | 0.0024 | 0.0024 | | 0.2 | Yes |
| 6 | Ex. | Bal. | 0.20 | 0.5 | 2.0 | 0.0210 | 0.0160 | 0.0020 | 0.0025 | Mg: 0.004 | 0.1 | Yes |
| 7 | Ex. | Bal. | 0.20 | 1.0 | 2.0 | 0.0150 | 0.0150 | 0.0029 | 0.0011 | Zr: 0.040 | 0.1 | Yes |
| 8 | Ex. | Bal. | 0.20 | 1.8 | 2.2 | 0.0170 | 0.0210 | 0.0019 | 0.0021 | B: 0.001 | 0.2 | Yes |
| 9 | Comp. ex. | Bal | 0.20 | 1.6 | 2.0 | 0.0200 | 0.0100 | 0.0017 | 0.0013 | | 0.1 | Yes |
| 10 | Comp. ex. | Bal. | 0.20 | 1.6 | 2.0 | 0.0320 | 0.0130 | 0.0015 | 0.0025 | | 0.1 | Yes |
| 11 | Comp. ex. | Bal. | 0.20 | 1.6 | 2.0 | 0.0040 | 0.0110 | 0.0025 | 0.0012 | | 0.3 | Yes |
| 12 | Comp. ex. | Bal. | 0.20 | 1.6 | 2.0 | 0.0070 | 0.0080 | 0.0026 | 0.0014 | | 0.2 | Yes |
| 13 | Comp. ex. | Bal. | 0.20 | 1.6 | 2.0 | 0.0250 | 0.0030 | 0.0017 | 0.0016 | | 0.1 | Yes |
| 14 | Comp. ex. | Bal. | 0.20 | 1.6 | 2.0 | 0.0210 | 0.0070 | 0.0013 | 0.0018 | | 0.3 | Yes |
| 15 | Comp. ex. | Bal. | 0.20 | **4.5** | 2.0 | 0.0014 | 0.0150 | 0.0023 | 0.0020 | | 0.2 | Yes |
| 16 | Comp. ex. | Bal. | 0.20 | **0.0** | 2.0 | 0.0015 | 0.0090 | 0.0024 | 0.0021 | | 0.1 | Yes |
| 17 | Comp. ex. | Bal. | 0.20 | 1.6 | **6.0** | 0.1000 | 0.0160 | 0.0011 | 0.0021 | | 0.1 | Yes |
| 18 | Comp. ex. | Bal. | 0.20 | 1.8 | **0.0** | 0.0300 | 0.0080 | 0.0010 | 0.0023 | | 0.1 | Yes |
| 19 | Comp. ex. | Bal. | 0.40 | 1.6 | 2.0 | 0.0500 | 0.0250 | 0.0016 | 0.0020 | | **9.3** | Yes |
| 20 | Ex. | Bal. | 0.20 | 3.0 | 2.0 | 0.0240 | 0.0040 | 0.0012 | 0.0018 | Ni: 0.90 | 0.1 | Yes |
| 21 | Ex. | Bal. | 0.20 | 1.8 | 5.0 | 0.0210 | 0.0120 | 0.0020 | 0.0019 | Cr: 1.00 | 0.2 | Yes |
| 22 | Ex. | Bal. | 0.20 | 1.0 | 2.3 | 0.0360 | 0.0090 | 0.0013 | 0.0017 | | 0.1 | Yes |
| 23 | Ex. | Bal. | 0.20 | 1.8 | 2.0 | 0.0380 | 0.0080 | 0.0025 | 0.0012 | | 0.2 | Yes |
| 24 | Ex. | Bal. | 0.25 | 1.5 | 2.3 | 0.0400 | 0.0160 | 0.0024 | 0.0025 | Ti: 0.030 | 0.2 | Yes |
| 25 | Ex. | Bal. | 0.25 | 1.5 | 2.0 | 0.0420 | 0.0110 | 0.0021 | 0.0021 | V: 0.050 | 0.1 | Yes |
| 26 | Ex. | Bal | 0.30 | 1.5 | 2.3 | 0.0230 | 0.0130 | 0.0023 | 0.0020 | | 0.1 | Yes |
| 27 | Ex. | Bal. | 0.30 | 1.8 | 0.3 | 0.0390 | 0.0080 | 0.0022 | 0.0018 | Nb: 0.020 | 0.1 | Yes |
| 28 | Ex. | Bal. | 0.35 | 1.8 | 3.0 | 0.0380 | 0.0040 | 0.0024 | 0.0016 | Cu: 0.01 | 0.3 | Yes |
| 29 | Ex. | Bal. | 0.35 | 1.8 | 2.0 | 0.0280 | 0.0090 | 0.0020 | 0.0034 | | 0.1 | Yes |
| 30 | Ex. | Bal. | 0.40 | 1.8 | 2.0 | 0.0270 | 0.0070 | 0.0022 | 0.0011 | Mo: 0.40 | 0.4 | Yes |
| 31 | Ex. | Bal. | 0.40 | 1.8 | 2.0 | 0.0160 | 0.0120 | 0.0017 | 0.0010 | W: 0.02 | 0.1 | Yes |
| 32 | Ex. | Bal. | 0.40 | 1.8 | 2.0 | 0.0170 | 0.0140 | 0.0015 | 0.0009 | Ca: 0.001 | 0.2 | Yes |
| 33 | Ex. | Bal. | 0.40 | 1.8 | 2.0 | 0.0280 | 0.0080 | 0.0011 | 0.0014 | | 0.1 | Yes |
| 34 | Comp. ex. | Bal. | 0.40 | 1.6 | 2.0 | 0.0340 | 0.0090 | 0.0017 | 0.0017 | | 0.1 | Yes |
| 35 | Comp. ex. | Bal. | 0.20 | 1.0 | 2.3 | 0.0310 | 0.0110 | 0.0021 | 0.0022 | | 0.2 | **No** |

| | Annealing conditions | | | | Form of internal oxides: Granular | | Grain | Si-Mn depleted layer | | | | Performance | |
|---|---|---|---|---|---|---|---|---|---|---|---|---|---|
| | | Dew point | Holding temp. | Holding time | Average grain size | Number density | boundary Ratio A | Thickness | Depletion rate (%) | | Plating | Plate- | Hydrogen discharge- |
| No. | Tension | (° C.) | (° C.) | (s) | (nm) | (/μm$^2$) | (%) | (μm) | Si | Mn | type | ability | abillity |
| 1 | Yes | 0 | 850 | 50 | — | 0 | **25** | 5.2 | **20** | **25** | A | G | P |
| 2 | Yes | 0 | 850 | 50 | 150 | 2.6 | 100 | 7.2 | 8 | 6 | A | G | G |
| 3 | Yes | 0 | 820 | 50 | 100 | 2.8 | 100 | 4.8 | 3 | 2 | A | G | VG |
| 4 | Yes | 0 | 830 | 50 | 120 | 2.5 | 100 | 4.1 | 2 | 3 | A | G | VG |
| 5 | Yes | 0 | 800 | 50 | 70 | 1.6 | 98 | 5.3 | 1 | 3 | A | G | VG |
| 6 | Yes | 0 | 800 | 50 | 50 | 1.3 | 98 | 4.5 | 1 | 1 | A | G | VG |
| 7 | Yes | 0 | 860 | 50 | 150 | 2.4 | 100 | 8.1 | 2 | 1 | B | G | VG |
| 8 | Yes | 0 | 840 | 50 | 120 | 2.1 | 100 | 6.1 | 2 | 3 | C | G | VG |
| 9 | Yes | **−40** | 840 | 50 | — | 0 | **0** | — | — | — | A | P | P |
| 10 | Yes | **20** | 840 | 50 | 340 | 1.2 | **35** | 12.3 | **60** | **55** | A | P | P |
| 11 | Yes | 0 | **940** | 50 | 210 | 1.5 | **25** | 15.4 | **28** | **25** | A | P | P |
| 12 | Yes | 0 | **730** | 50 | 100 | **5.3** | **30** | 3.9 | 6 | 8 | A | G | P |
| 13 | Yes | 0 | 840 | **5** | — | 0 | **0** | — | — | — | A | P | P |
| 14 | Yes | 0 | 840 | **350** | 340 | **5.8** | 97 | 13.3 | 8 | **24** | A | G | P |
| 15 | Yes | 0 | 840 | 50 | 300 | 1.3 | **40** | 10.3 | **77** | **78** | A | P | P |

TABLE 1-continued

| | | | | | | | | | | | | | |
|---|---|---|---|---|---|---|---|---|---|---|---|---|---|
| 16 | Yes | 0 | 840 | 50 | — | 0 | **0** | — | — | — | A | G | P |
| 17 | Yes | 0 | 840 | 50 | 360 | 1.4 | **35** | 8.4 | **80** | **60** | A | P | P |
| 18 | Yes | 0 | 840 | 50 | — | **0** | **0** | — | — | — | A | G | P |
| 19 | Yes | 0 | 840 | 50 | — | **0** | **20** | **1.3** | **98** | **94** | A | G | P |
| 20 | Yes | 0 | 840 | 50 | 150 | 3.1 | 100 | 5.6 | 1 | 1 | A | G | VG |
| 21 | Yes | 0 | 840 | 15 | 80 | 2.1 | 71 | 3.2 | 3 | 1 | A | G | VG |
| 22 | Yes | 0 | 840 | 50 | 140 | 1.4 | 100 | 4.6 | 2 | 2 | A | G | VG |
| 23 | Yes | 0 | 840 | 10 | 120 | 1.9 | 58 | 3.6 | 2 | 2 | A | G | VG |
| 24 | Yes | 0 | 840 | 50 | 150 | 2.3 | 100 | 6.4 | 2 | 3 | A | G | VG |
| 25 | Yes | 0 | 840 | 50 | 130 | 0.8 | 98 | 4.4 | 5 | 6 | A | G | G |
| 26 | Yes | 0 | 840 | 50 | 140 | 2.4 | 100 | 7.1 | 3 | 2 | A | G | VG |
| 27 | Yes | 0 | 840 | 50 | 150 | 1.4 | 100 | 6.9 | 1 | 3 | A | G | VG |
| 28 | Yes | 0 | 880 | 50 | 150 | 1.3 | 100 | 10.2 | 2 | 2 | A | G | VG |
| 29 | Yes | 0 | 840 | 50 | 140 | 1.9 | 100 | 4.8 | 3 | 2 | A | G | VG |
| 30 | Yes | 0 | 840 | 20 | 100 | 2.6 | 78 | 3.9 | 2 | 1 | A | G | VG |
| 31 | Yes | 0 | 840 | 50 | 120 | 2.2 | 100 | 4.5 | 2 | 1 | A | G | VG |
| 32 | Yes | 0 | 840 | 50 | 140 | 1.1 | 100 | 5.9 | 1 | 2 | A | G | VG |
| 33 | Yes | 0 | 840 | 50 | 150 | 2.3 | 100 | 4.8 | 2 | 3 | A | G | VG |
| 34 | **No** | 0 | 840 | 40 | 190 | 2.0 | **30** | 9 | **50** | **40** | A | G | P |
| 35 | Yes | 0 | 840 | 50 | 200 | 2.2 | **15** | **2.1** | **98** | **98** | A | G | P |

Bold underlines indicate outside scope of present invention or off from preferable range.

In each of Sample Nos. 2 to 8 and 20 to 33, the chemical composition, Ratio A of grain boundary oxides, number density of granular oxides, and thickness and composition of the Si—Mn depleted layer were suitable, so high plateability and hydrogen dischargeability were exhibited. On the other hand, in each of Sample Nos. 1 and 19, the internal oxidation layer was deep before annealing, the grain boundary oxides were not sufficiently formed, and the desired Si—Mn depleted layer was also not formed, so high hydrogen dischargeability was not obtained. In Sample No. 9, the dew point at the time of annealing was low, an external oxidation layer was formed, internal oxides were not formed, and the desired Si—Mn depleted layer was also not formed, so high plateability and hydrogen dischargeability were not obtained. In Sample No. 10, the dew point at the time of annealing was high, external oxides were formed, internal oxides were not sufficiently formed, and the desired Si—Mn depleted layer was also not formed, so a high plateability and hydrogen dischargeability were not obtained. In Sample No. 11, the holding temperature at the time of annealing was high, external oxides grew, internal oxides were not sufficiently formed, and the desired Si—Mn depleted layer was also not formed, so a high plateability and hydrogen dischargeability were not obtained. In Sample No. 12, the holding temperature at the time of annealing was low, formation of granular oxides was promoted, a grain boundary oxidation layer was not sufficiently formed, and a high hydrogen dischargeability was not obtained. In Sample No. 13, the holding time at the time of annealing was short, internal oxides were not formed, and the desired Si—Mn depleted layer was also not formed, so high plateability and hydrogen dischargeability were not obtained. In Sample No. 14, the holding time at the time of annealing was long, numerous granular oxides were formed, and the desired Si—Mn depleted layer was also not formed, so high hydrogen dischargeability was not obtained. In Sample No. 15, the amount of Si was excessive, external oxides grew, internal oxides were not sufficiently formed, and the desired Si—Mn depleted layer also was not formed, so high plateability and hydrogen dischargeability were not obtained. In Sample Nos. 16 and 18, the respective amount of Si and amount of Mn were 0 (zero) and, in each, the internal oxidation layer was not formed and the desired Si—Mn depleted layer was also not formed, so a high hydrogen dischargeability was not obtained. In Sample No. 17, the amount of Mn was excessive, external oxides grew, internal oxides were not sufficiently formed, and the desired Si—Mn depleted layer also was not formed, so high plateability and hydrogen dischargeability were not obtained. In Sample No. 34, tension was not applied at the time of annealing, so grain boundary oxides were not sufficiently formed and the desired Si—Mn depleted layer was also not formed, so a high hydrogen dischargeability was not obtained. In Sample No. 35, grinding was not performed before annealing, so grain boundary oxides were not sufficiently formed and the desired Si—Mn depleted layer was also not formed, so a high hydrogen dischargeability was not obtained.

INDUSTRIAL APPLICABILITY

According to the present invention, high strength steel sheet and plated steel sheet having a high plateability and hydrogen dischargeability can be provided. The steel sheet and plated steel can be suitably used for automobiles, home electric appliances, building materials, and other applications, in particular for automobiles. As steel sheet for automobile use and plated steel sheet for automobile use, higher collision safety and longer life can be expected. Therefore, the present invention can be said to be extremely high in value in industry.

REFERENCE NOTATIONS

1 steel sheet
2 external oxidation layer
3 base steel
11 steel sheet
12 granular oxides
13 grain boundary oxides
14 base steel

The invention claimed is:

1. A steel sheet having a chemical composition comprising, by mass %,

C: 0.05 to 0.40%,
Si: 0.2 to 3.0%,
Mn: 0.1 to 5.0%,
sol. Al: 0 to less than 0.4000%,
P: 0.0300% or less,
S: 0.0300% or less,
N: 0.0100% or less,
B: 0 to 0.010%,
Ti: 0 to 0.150%, Nb: 0 to 0.150%,
V: 0 to 0.150%,
Cr: 0 to 2.00%,
Ni: 0 to 2.00%,
Cu: 0 to 2.00%,
Mo: 0 to 1.00%,
W: 0 to 1.00%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein
a surface layer of the steel sheet contains grain boundary oxides,
a Ratio A of a length of the grain boundary oxides projected on a surface of the steel sheet to a length of the surface of the steel sheet when examining a cross-section of the surface layer of the steel sheet is 50% or more and 100% or less,
a number density of granular oxides is less than 4.0/$\mu m^2$,
the steel sheet comprises an Si—Mn depleted layer having a thickness of 3.0 μm or more from the surface of the steel sheet, and
Si and Mn contents of the Si—Mn depleted layer at ½ position of the thickness and not containing oxides are respectively less than 10% of the Si and Mn contents at a sheet thickness center part of the steel sheet.

2. The steel sheet according to claim 1, wherein the Ratio A is 80% or more.

3. The steel sheet according to claim 1, wherein the Ratio A is 90% or more.

4. The steel sheet according to claim 1, wherein the number density of the granular oxides is less than 2.0/$\mu m^2$.

5. A plated steel sheet having a plating layer including Zn on the steel sheet of claim 1.

6. The steel sheet according to claim 2, wherein the number density of the granular oxides is less than 2.0/$\mu m^2$.

7. The steel sheet according to claim 3, wherein the number density of the granular oxides is less than 2.0/$\mu m^2$.

8. A plated steel sheet having a plating layer including Zn on the steel sheet of claim 2.

9. A plated steel sheet having a plating layer including Zn on the steel sheet of claim 3.

10. A plated steel sheet having a plating layer including Zn on the steel sheet of claim 4.

* * * * *